United States Patent [19]

Lautensleger et al.

[11] 4,349,996

[45] Sep. 21, 1982

[54] INTEGRATED ROOF SYSTEM

[75] Inventors: Richard W. Lautensleger, Middletown; Richard D. Shepard, Monroe; Paul A. Seaburg, Middletown, all of Ohio

[73] Assignee: Armco Inc., Middletown, Ohio

[21] Appl. No.: 143,261

[22] Filed: Apr. 24, 1980

[51] Int. Cl.[3] ..... E04B 7/00; E04C 3/04

[52] U.S. Cl. ..... 52/655; 52/363; 52/643; 52/693; 403/230

[58] Field of Search ..... 52/690, 262, 691, 639, 52/650, 692, 18, 263, 655; 403/188

[56] References Cited

U.S. PATENT DOCUMENTS

| | | | |
|---|---|---|---|
| 607,335 | 7/1898 | Boring | 52/639 |
| 1,943,256 | 1/1934 | Durr | 52/655 |
| 3,019,861 | 2/1962 | Rasch | 52/639 |
| 3,314,209 | 4/1967 | Troutner | 52/639 |
| 3,318,055 | 5/1967 | Piana | 52/18 |
| 3,893,276 | 7/1975 | Brown | 52/655 |
| 3,978,635 | 9/1976 | Theault | 52/18 |

FOREIGN PATENT DOCUMENTS

| | | | |
|---|---|---|---|
| 2551400 | 7/1976 | Fed. Rep. of Germany | 52/691 |

*Primary Examiner*—John E. Murtagh

*Attorney, Agent, or Firm*—Frost & Jacobs

[57] ABSTRACT

An integrated roof system for buildings of the type wherein the roof structure is supported on spaced apart rafters, the system comprising a series of V-trusses extending between the rafters at spaced apart intervals, the V-trusses comprising independent load supporting units which are self-bracing and do not require interconnecting bracing members. The V-trusses are formed from half-truss sections having top and bottom chords interconnected by webbing, the half-truss sections being diagonally disposed with respect to each other with their bottom chords juxtaposed and their top chords interconnected by tie members. The system includes seat members at the ends of the top chords by means of which the V-trusses are secured to the rafters, and a roof structure adapted to be secured to the top chords of the V-trusses.

19 Claims, 13 Drawing Figures

INTEGRATED ROOF SYSTEM

INTEGRATED ROOF SYSTEM

This invention relates to prefabricated building structures and more particularly to an improved roofing system for a building of the type having spaced apart rafters or beams which carry the load supporting members for the roof.

BACKGROUND OF THE INVENTION

In prefabricated buildings, essentially two types of roof supporting structures are currently employed. The first type of supporting structure is the rafter-purlin system which utilizes essentially linear or one-way structural members. The problem with using one-way purlins or joists is instability in the lateral direction. This problem requires the extensive use of bracing members between the purlins or joists, which adds materially to the cost of the building, particularly since the bracing members must be individually installed on the job site after the one-way structural members have been put in place.

The second type of load supporting structure is composed of three-dimensional interlocking trusses which form a grid structure. Such structures are usually constructed in place on the job site by assembling a large number of three-dimensional units into a complete grid system. While structures of this type are quite strong, they are also expensive due to the labor needed to fabricate and erect the individual units into a complete grid structure.

In contrast to the foregoing, the present invention contemplates a roof system utilizing individual load supporting truss units which are self-bracing and have a high capacity for both vertical and lateral loading, the units being readily assembled on the job site and installed with a minimum of labor. While primarily intended as load supporting units in a roof, the truss units of the present invention also may be used as structural members for supporting flooring, wall girts and the like.

BRIEF SUMMARY OF THE INVENTION

In accordance with the invention the roof supporting system comprises a series of individual, spaced truss units adapted to extend at regular intervals between the building rafters, the units acting to directly support the roof covering. The individual truss units are triangular or V-shaped in cross-section and for convenience will be referred to as V-trusses. Each V-truss is composed of two half-truss sections each having spaced apart top and bottom hollow, essentially square chords interconnected by diagonally disposed tubular web members. The chords have slot-defining flanges extending lengthwise along one corner edge, the flanged slots being of a size to receive the web members. Since the flanged slots lie along a longitudinal edge of the chords, the sides or faces of the essentially square chords will be diagonally disposed with respect to the plane defined by the web members.

The half-truss sections may be shop fabricated and shipped to the job site where pairs of the half-truss sections will be assembled on the ground prior to being positioned on the rafters, the assembly consisting of diagonally disposing the half-truss sections relative to each other with the facing surfaces of the bottom chords juxtaposed and secured to each other, the top chords being interconnected by tie members at points preferably coinciding with the ends of the diagonally disposed web members, thereby forming a complete V-truss unit.

Upon assembly, the V-truss units are hoisted into position between the rafters, with the opposite ends of the top chord members seated on the rafters. To this end, prefabricated seat members are provided to anchor the V-truss units to the rafters, the seat members being secured to the opposite ends of the top chords as an incident of the shop fabrication of the half-truss sections. The V-truss units extend between the rafters in spaced apart parallel relation, preferably on centers which are twice the width of the V-truss units measured at their top chords. When installed, the V-truss units are independent of each other and interconnecting bracing is not required.

Another feature of the present invention resides in the utilization of prefabricated metal roofing panels having fasteners by means of which the roofing panels are secured to the top chords of the V-trusses. Preferably, the fasteners will be of the concealed type, although through-fasteners also may be used. The purpose of concealed fasteners is to eliminate leakage problems encountered with through-fasteners, particularly during movement of the roofing panels caused by thermal expansion as well as lateral loading. A preferred form of roof panel construction is taught in U.S. Pat. No. 4,102,105, issued July 25, 1978, wherein the roofing panels are provided along their opposite edges with inverted channel-shaped ribs adapted to be interlocked to form tight joints between adjoining panels. Concealed fasteners in the form of clip connectors are utilized to secure the roof panels to the top chords of the V-trusses, the clip connectors being engaged between the interlocked ribs of adjoining panels. It has been found that by mounting the concealed fasteners on the top chords of the V-trusses, the V-trusses have sufficient lateral restraint to insure that the roof panels will move relative to the concealed fasteners when subjected to thermal expansion.

The geometric arrangement of the assembled V-truss and installed roof panels is significant in achieving the desired structural behavior of the assembly. There is a tendency for the top chords to deflect due to lateral loads or as a result of lateral instability in a direction perpendicular to the plane of the web members. When this direction is also the direction of the plane of the roof panels, the roof panels must be firmly attached to the top chord and must possess shear strength in the plane of the roof in order to restrain this deflection tendency. This is difficult to achieve while allowing for relative movement between the roof panels and top chords as previously described. In the V-truss assembly of the present invention the tendency for the top chords to deflect is restrained by the bending strength of the roof panels. If additional restraint is required, diagonal braces may be installed between adjacent top chord ties.

The present invention thus provides an integrated roofing structure of simple yet efficient construction, which is easy to fabricate and install, and hence economically feasible. At the same time, the system is extremely strong and capable of withstanding high loads without adversely affecting the integrity of the structure.

DETAILED DESCRIPTION

Figure 1:
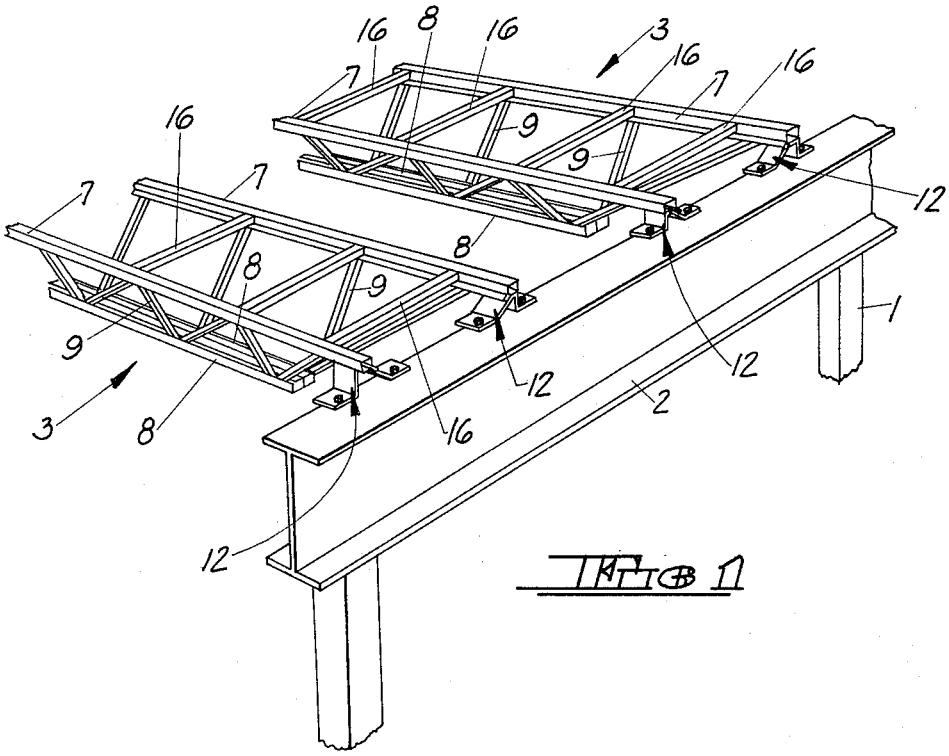
FIG. 1 is a perspective view of the load supporting structure for a building in accordance with the present invention.
Figure 2:
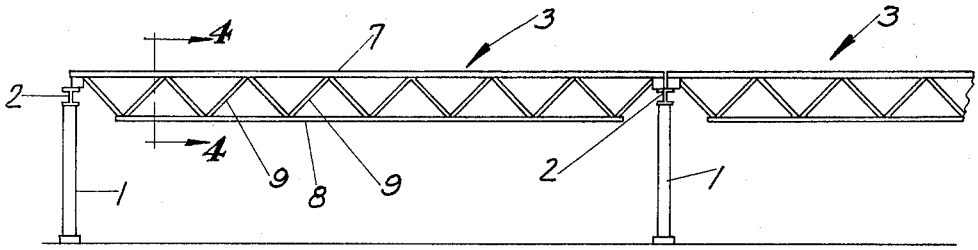
FIG. 2 is an elevational view of the load supporting structure taken lengthwise of the V-truss units.
Figure 3:
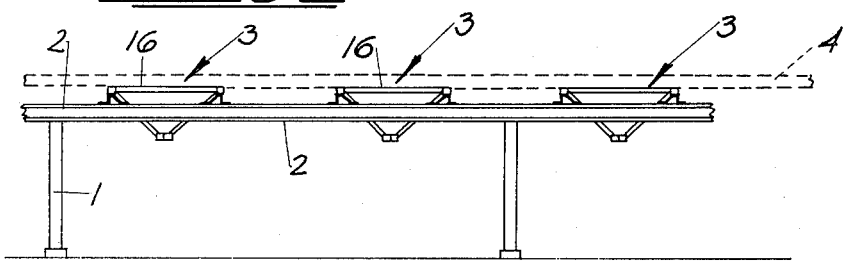
FIG. 3 is an elevational view of the load supporting structure taken at right angles to FIG. 2.

Referring now to the drawings, and with particular reference to FIGS. 1 through 3, the basic building structure comprises spaced apart upright columns 1 which support the beams or rafters 2 which in this exemplary embodiment are of I-shape in cross-section and supported on the columns in conventional fashion. Other forms of beams may be used, such as conventional linear trusses oriented in the vertical plane. A plurality of V-truss units 3 extend between and are supported at their opposite ends of the rafters 2, the V-truss units being arranged in spaced apart rows and acting to directly support the building roof covering, which is diagrammatically indicated at 4 in FIG. 3. The spaced apart V-truss units are independent of each other and, due to their configuration, are self-bracing and have a high capacity for both vertical and lateral loads. While in the embodiment illustrated the V-truss units serve as supports for the building roof covering, they also can be utilized as floor joists or for wall girts in building structures.

Figure 4:
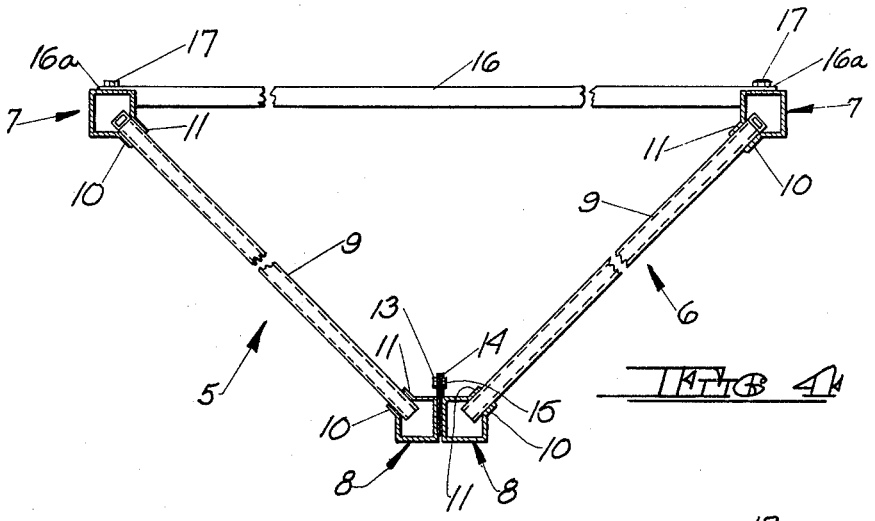
FIG. 4 is an enlarged vertical sectional view of the V-truss unit taken along the line 4—4 of FIG. 2.
Figure 12:
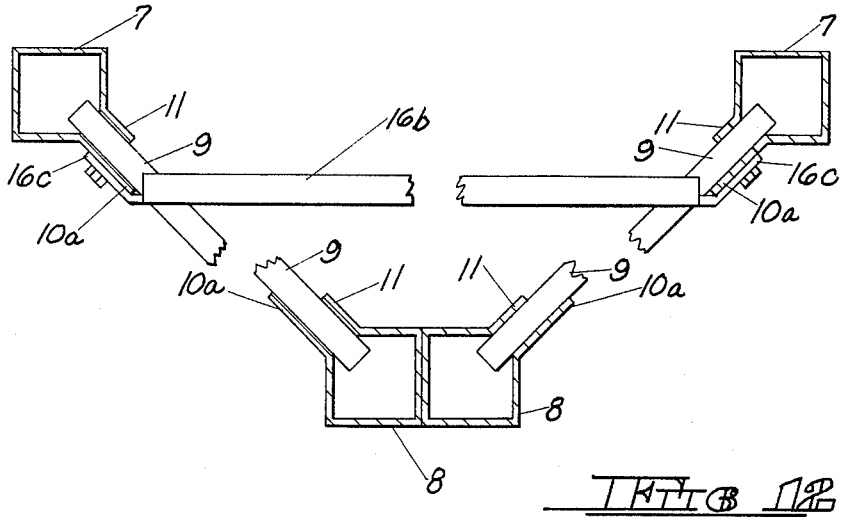
FIG. 12 is an enlarged fragmentary vertical sectional view of a modified V-truss construction.

Each V-truss unit is composed of a pair of half-truss sections, such sections being indicated generally at 5 and 6 in FIG. 4. Each section comprises a top chord 7 and a bottom chord 8 interconnected by diagonally disposed web members 9. The chords 7 and 8 are essentially square in cross-section, preferably being roll-formed to the shape illustrated, the chords each having spaced apart flanges 10 and 11 projecting outwardly from one corner edge thereof to define a longitudinal slot of a size to receive the ends of the web members 9. The flanges 10 and 11 may be of substantially equal length, as shown in FIG. 4, or one flange may be made substantially longer than the other, as seen at 10*a* in FIG. 12, this alternative arrangement facilitating assembly of the web and chord members by permitting all welding to be done from one side of the truss sections.

Figure 5:
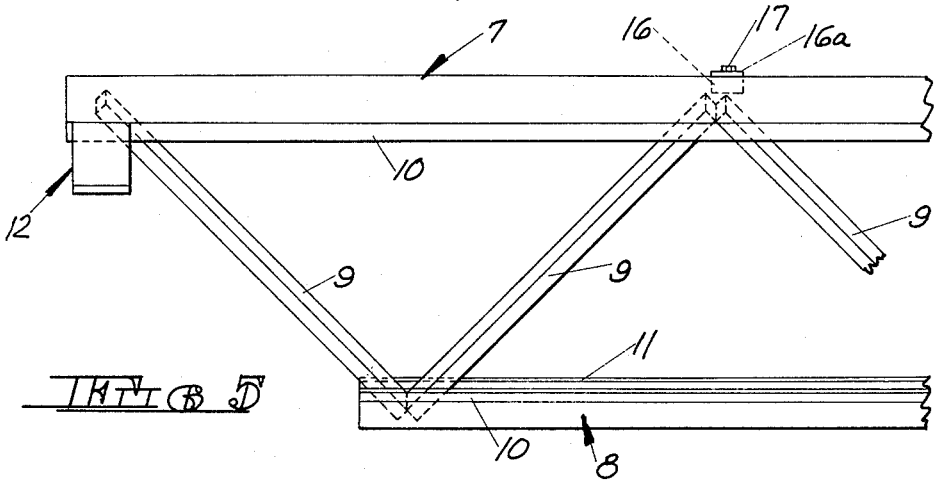
FIG. 5 is an enlarged fragmentary side elevational view of one end of the V-truss unit.

The half-truss sections preferably will be fabricated in the shop, the web members preferably being made from standard square or rectangular tubing, the chord and web members being laid out in a shop jig and welded together to form essentially linear half-truss sections in which the faces or sides of the chords are diagonally disposed with respect to the plane of the truss sections. Preferably, the web members 9 will extend inwardly into the hollow interiors of the chords and will be welded to the flanges 10 and 11. The web members will be cut to the desired lengths, or a plurality of adjoining web members may be formed from a single length of tube stock which is cut at spaced intervals on three sides and bent on the fourth side to provide an integral series of diagonally disposed web members. Seats 12, one of which is illustrated in FIG. 5, will be fabricated and welded in the shop to each end of the top chord of each half-truss section. The prefabricated half-truss sections, which may be easily stacked, are then shipped to the job site where they are assembled into V-truss units prior to installation on the rafters.

At the job site, two half-truss sections will be set manually or by lift truck or crane in a simple jig on the ground which will diagonally dispose an opposing pair of the half-truss sections 5 and 6, the diagonally disposed sections defining an angle of approximately 90° therebetween, and their bottom chords will be juxtaposed in the manner seen in FIG. 4. Due to the square configuration of the chords and their diagonal disposition, the abutting vertically disposed sides of the bottom chords will lie in face-to-face relation and may be readily welded together, or if desired, they may be connected by means of tie plates 13 and 14 joined together by a series of bolts 15. The tie plates may be continuous throughout the lengths of the bottom chords, or they may be provided at spaced apart intervals. Alternatively, strap or clamp-like fasteners may be utilized, although in some applications the bottom chords of the sections may be rigidly joined together, as by welding, to enhance the overall strength of the truss units.

When the truss units 5 and 6 are diagonally disposed relative to each other, the uppermost or top surfaces of the top chords will lie in a horizontal plane, and as will be pointed out hereinafter, serve to mount the fasteners for the roof covering. The top chords are tied together at spaced apart intervals by tie members 16 extending between the top chords, the tie members preferably being cold formed steel shapes. Preferably, the tie members will coincide with the juncture of the uppermost ends of an adjacent pair of web members 9, as will be evident from FIG. 5, although other spacing may be employed if desired. In the embodiment illustrated, the tie members 16 are provided at their opposite ends with projecting tongues 16*a*, the tongues seating on the flat top surfaces of the upper chords 7 where they are anchored by means of self-drilling screws 17 or other mechanical fasteners, or the tie members can be welded to the top chords. Once assembled, the V-truss units will be lifted onto the building rafters 2 where they will be seated and anchored by means of the seat members 12. In an alternative arrangement illustrated in FIG. 12, the tie members 16*b* are positioned to create a space between their top surfaces and the tops of the upper chords 7 to facilitate the installation of thermal insulation into the roof system. To this end, the tie members 16*b* are provided at their opposite ends with elongated angularly disposed tongues 16*c* adapted to lie along the elongated flange 10*a*, the tongue being secured to the flange in any desired manner.

Figure 6:
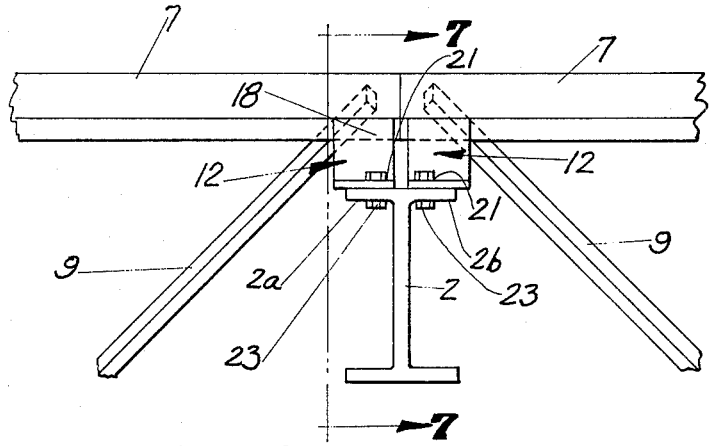
FIG. 6 is an enlarged fragmentary side elevational view illustrating the manner in which the abutting ends of a pair of V-truss units are mounted on a rafter.
Figure 7:
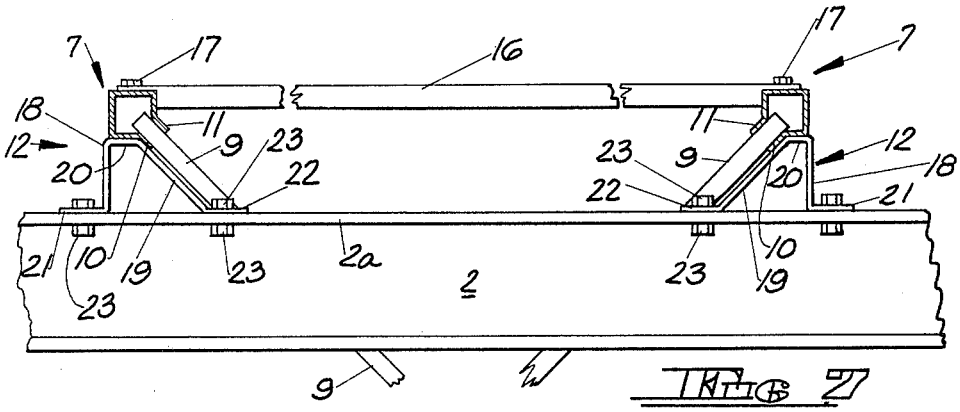
FIG. 7 is a vertical sectional view taken along the line 7—7 of FIG. 6.

As seen in FIGS. 6 and 7, the seat members 12 are formed from bar, sheet or strip stock configured to define supporting legs 18 and 19 interconnected by a seat portion 20 which is welded to the undersides of the top chords 7 at their opposite ends. The legs 18 are vertically disposed, whereas the legs 19 are inclined so that they will lie along the flanges 10 of the top chords and also the adjoining web members 9 which may be welded to the flanges of the top chords and to the legs 19, thereby providing a stronger connection. The connection of the web members 9 to legs 19 also provide increased shear capacity. The pairs of legs 18 and 19 have outwardly directed feet 21 and 22, respectively, by means of which the seat members are anchored to the rafters 2, as by bolts 23. As will be apparent from FIG. 6, where the V-Trusses are aligned end to end, an abutting pair of V-trusses may be seated on the oppositely directed top flange elements 2*a* and 2*b* of the I-shaped rafter. The feet of the seats may be pre-drilled, and consequently it is only necessary to provide mating holes in the flange of the rafter to receive the bolts 23.

Figure 8:
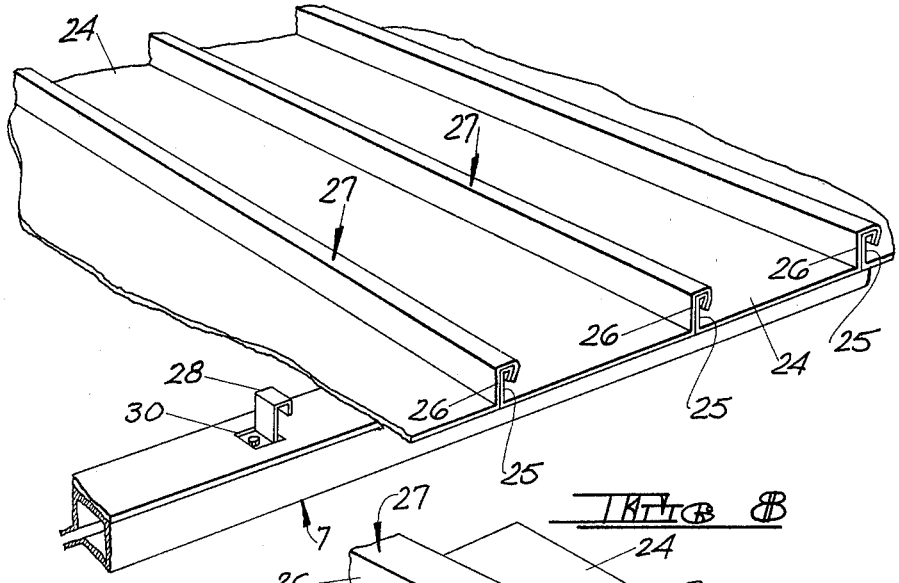
FIG. 8 is a perspective view of a roof covering incorporating rib forming joints and hidden fasteners.
Figure 9:
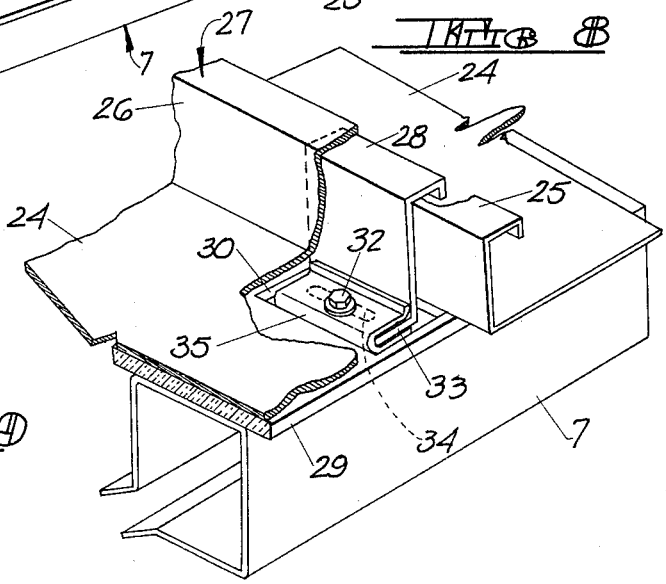
FIG. 9 is an enlarged fragmentary perspective view illustrating the manner in which the roof covering and hidden fasteners are mounted on the V-truss units.
Figure 10:
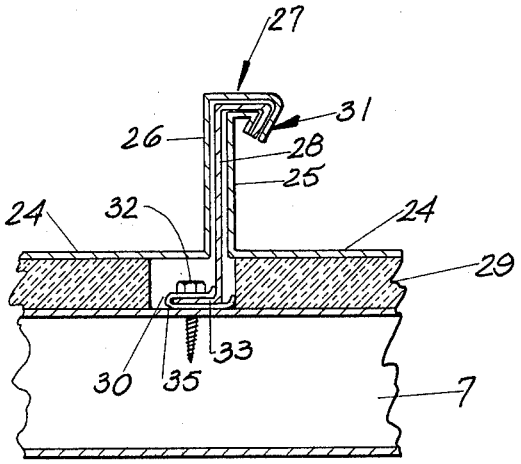
FIG. 10 is an enlarged vertical sectional view of a rib forming joint and hidden fastener.

Following installation of the V-truss units, the roof covering is applied over the top chords of the V-trusses. As seen in FIG. 8, a preferred roof construction comprises a series of relatively stiff and rigid interlocked metal panels 24 provided along their opposite edges with inverted channel-shaped ribs 25 and 26 adapted to be interlocked to form tight joints 27 between adjoining panels. The joint forming ribs 25 and 26 extend at right angles to the top chords 7 of the V-trusses and are secured to the V-trusses by concealed fasteners 28 mounted on the top chords 7 of the V-trusses. The roof panels 24 are seated on insulation strips 29 applied to the upper surfaces of the top chords, the insulation strips preferably being formed from a low heat conductance, non-metallic material provided with apertures 30 for receiving the fasteners 28. As will be apparent from FIG. 9, the channel-shaped ribs 25 are adapted to be received within the channel-shaped ribs 26, with the concealed fastener 28 sandwiched therebetween. The integrity of the joint is maintained by crimping the free edges of the ribs inwardly to the position indicated at 31 in FIG. 10.

The fasteners 28 are attached to the chords 7 by means of self-drilling screws 32. To this end, the foot 33 of the fastener 28 is provided with an elongated slot 34 extending lengthwise thereof, the foot being engaged between the opposite sides of a U-shaped washer 35, the washer having aligned apertures therein through which the screw 32 passes. With this arrangement, the fasteners may move relative to the top chords to allow for shifting of the roof panels due to thermal expansion.

Figure 11:
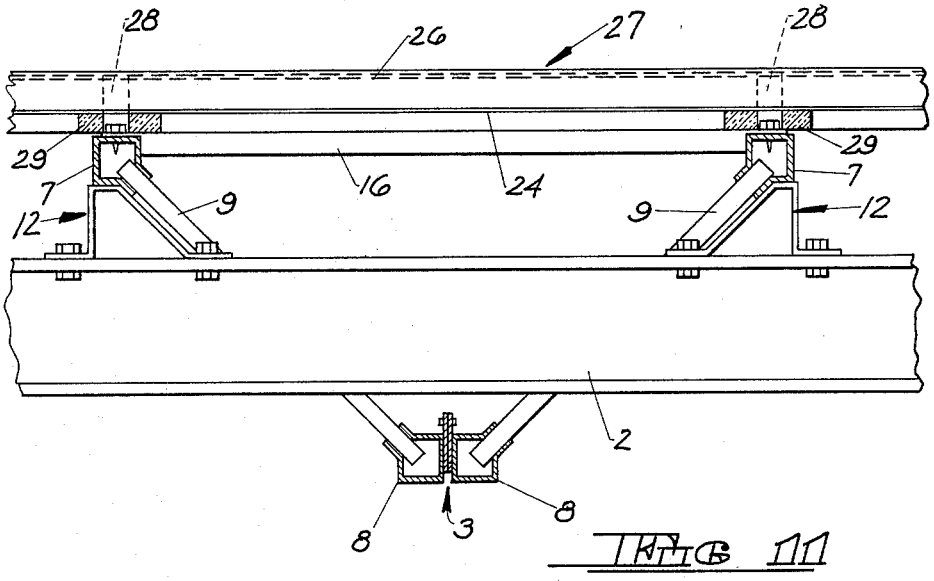
FIG. 11 is a vertical sectional view similar to FIG. 7 illustrating the assembled roofing system.
Figure 13:
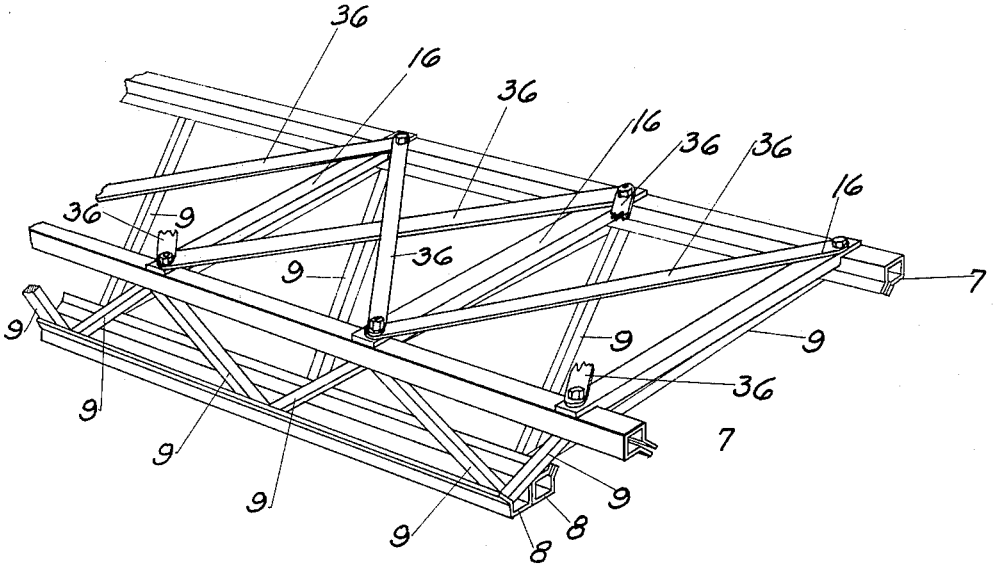
FIG. 13 is a fragmentary perspective view of a V-truss incorporating restraining braces extending diagonally between the top chord ties.

As previously noted, the present invention may utilize interlocking roof panels and hidden fasteners of the types disclosed in U.S. Pat. No. 4,102,105, to which reference is made for details of their construction and mode of assembly. The completed roof structure is seen in FIG. 11, and while a hidden fastener roof system is preferred, the roofing panels can be of any conventional design known to the metal building industry, and various types of fasteners may be employed to fasten the roofing panels to the top chords, such as self-drilling through-fasteners. While any tendency on the part of the top chords to deflect is restrained by the bending strength of the roof panels, circumstances may be encountered where additional restraint is required. To this end, and as seen in FIG. 13, brace members 36 may be installed diagonally between adjacent top chord ties 16. The brace members 36 may be steel straps or cold formed steel shapes, and they may be installed in a single diagonal direction or in the double diagonal direction, as shown, depending upon the desired amount of additional restraint.

As should now be evident, the present invention provides an integrated roof system in which V-truss units are utilized to provide effective support for external forces acting on roofing panels attached to the supporting structure by concealed fasteners. The roof system of the invention is of simple and inexpensive construction and can be easily installed on the job site. By eliminating the necessity for lateral bracing between adjacent V-truss units, the cost of the system is materially reduced yet it has outstanding strength characteristics, particularly with respect to lateral stability. In addition, the V-truss units may be utilized as load supporting structural members in other applications.

What is claimed is:

1. In a building of the type wherein the roof structure is supported on spaced apart rafters, an improved roof system comprising a series of V-trusses extending between the rafters in parallel relation at spaced apart intervals, said V-trusses each comprising a pair of half-truss sections each having a top chord and a bottom chord interconnected by web members, said truss sections being diagonally disposed with respect to each other with their bottom chords juxtaposed and secured together in face-to-face relation with their top chords spaced apart, tie members interconnecting the upper ends of said half-truss sections, seat members securing the opposite ends of the top chords of said V-trusses to said rafters, said seat members each comprising a pair of legs interconnected by an intermediate portion, feet on the lower ends of said legs, the intermediate portion of said seat member being secured to the top chord which it supports, and said feet being secured to the supporting rafter, said V-trusses being free from interconnecting braces, whereby said V-trusses comprise independent roof supporting members, and a roof structure supported on said V-trusses and secured to said top chords.

2. The roof system claimed in claim 1 wherein one of the legs of each seat member is also secured to an adjoining web member.

3. The roof system claimed in claim 1 wherein said top and bottom chords each comprises an elongated hollow member which is essentially square in cross-section and has a slot extending lengthwise along one corner edge thereof in which said web members are secured.

4. The roof system claimed in claim 3 wherein the slot in each chord is defined by an outwardly projecting pair of flanges defining the opposite sides of the slot, said flanges being diagonally disposed with respect to the adjoining sides of the chord.

5. The roof system claimed in claim 4 wherein one of said flanges in each pair is longer than the other flange.

6. The roof system claimed in claim 4 wherein said web members are diagonally disposed with respect to each other.

7. The roof system claimed in claim 4 wherein one of said legs of each seat member is inclined so as to parallel the adjoining slot forming flange, the intermediate portion of said seat member being secured to the underside of the top chord adjacent said last named flange.

8. The roof system claimed in claim 7 wherein the end web member is secured to the inclined leg of each seat member.

9. The roof system claimed in claim 1 wherein brace members extend diagonally between adjacent top chord tie members.

10. For use in a building structure, an improved V-truss unit consisting essentially of a pair of half-truss sections each having a top chord and a bottom chord interconnected by web members, said chords each comprising an elongated hollow member which is essentially square in cross-section and has a slot extending lengthwise along one corner edge thereof, the opposite sides of each slot being defined by a pair of outwardly projecting flanges which are diagonally disposed with respect to the adjoining sides of the chord, the ends of said web members being inserted in said slots and secured to said pairs of flanges, said half-truss sections being diagonally disposed with respect to each other with their bottom chords juxtaposed and secured together in face-to-face relation, and with their top chords spaced apart, and tie members interconnecting the upper ends of said half-truss sections, whereby to provide a self-sustaining load supporting unit having a high capacity for both vertical and lateral loading.

11. The improved V-truss claimed in claim 10 wherein one of the flanges in each pair is longer than the other.

12. The improved V-truss claimed in claim 10 wherein brace members extend diagonally between adjacent top chord tie members.

13. The improved V-truss claimed in claim 10 including seat means secured to the opposite ends of said top chords and projecting downwardly therefrom.

14. The improved V-truss claimed in claim 13 wherein said seat means each comprises a pair of legs interconnected by an intermediate portion, said intermediate portion being secured to the underside of said top chord, feet on the lower ends of said legs for securing said seat means to a supporting rafter.

15. The improved V-truss claimed in claim 14 wherein one of the legs of said seat means is inclined so as to parallel the adjoining slot forming flange of the chord.

16. The improved V-truss claimed in claim 15 wherein said web members are diagonally disposed with respect to each other, and wherein the end one of said web members is secured to the inclined leg of said seat member.

17. In a building of the type wherein the roof structure is supported on spaced apart rafters, an improved roof system comprising a series of V-trusses extending between the rafters in parallel relation at spaced apart intervals, said V-trusses each comprising a pair of half-truss sections each having a top chord and a bottom chord interconnected by web members, said top and bottom chords each comprising an elongated hollow member which is essentially square in cross-section and has a slot extending lengthwise along one corner edge thereof, the opposite sides of each slot being defined by a pair of outwardly projecting flanges which are diagonally disposed with respect to the adjoining sides of the chord, said web members being inserted in said slots and secured to said flanges, said truss sections being diagonally disposed with respect to each other with their bottom chords juxtaposed and secured together in face-to-face relation and with their top chords spaced apart, tie members interconnecting the upper ends of said half-truss sections, means securing the opposite ends of the top chords of said V-trusses to said rafters, said V-trusses being free from interconnecting braces, wherby said V-trusses comprise independent roof supporting members, and a roof structure supported on said V-trusses and secured to said top chords.

18. The roof system claimed in claim 1 or 17 wherein said roof structure comprising a series of panels having channel-shaped ribs extending along their opposite side edges, said ribs extending crosswise with respect to the top chords of said V-trusses with the ribs of adjoining panels fitted one within the other to form joints interconnecting said panels, channel-shaped fasteners mounted on said top chords at intervals corresponding to the locations of said joints, said fasteners being engagable between said interfitted ribs to provide concealed fasteners securing the roof panels to said trusses to form an integrated roof system.

19. The roof system claimed in claim 1 or 17 wherein adjoining V-trusses are spaced apart by a distance substantially equal to the width of the V-trusses measured at their top chords.

* * * * *